US005717288A

United States Patent [19]

Huang

[11] Patent Number: 5,717,288

[45] Date of Patent: Feb. 10, 1998

[54] PERFORATED SCREEN FOR BRIGHTNESS ENHANCEMENT

[75] Inventor: Jammy Chin-Ming Huang, Taipei, Taiwan

[73] Assignee: Industrial Technology Research Institute, Hsin-Chu, Taiwan

[21] Appl. No.: 742,107

[22] Filed: Oct. 31, 1996

Related U.S. Application Data

[62] Division of Ser. No. 387,082, Feb. 13, 1995, Pat. No. 5,595,519.

[51] Int. Cl.[6] ..... H01J 1/62

[52] U.S. Cl. ..... 313/496; 313/466

[58] Field of Search ..... 427/64, 68, 69; 313/495–497, 466; 445/24, 52

[56] References Cited

U.S. PATENT DOCUMENTS

| | | | |
|---|---|---|---|
| 4,651,053 | 3/1987 | Kato et al. | 313/466 |
| 4,857,799 | 8/1989 | Spindt et al. | 313/495 |
| 4,908,539 | 3/1990 | Meyer | 315/169.3 |
| 5,216,324 | 6/1993 | Curtin | 313/495 |
| 5,438,240 | 8/1995 | Cathey et al. | 315/169.1 |
| 5,477,105 | 12/1995 | Curtin et al. | 313/422 |
| 5,595,519 | 1/1997 | Huang | 445/24 |

*Primary Examiner*—Shrive Beck
*Assistant Examiner*—Brian K. Talbot
*Attorney, Agent, or Firm*—George O. Saile; Stephen B. Ackerman

[57] ABSTRACT

A field emission display with enhanced brightness and contrast, and a method for making such a display, is described. The display has a backplate and an opposing face plate, where a glass plate acts as a base for the faceplate. A patterned layer of transparent conductive material is formed over the glass plate, and acts as an anode for the display. There is a plurality of phosphorescent elements formed over the anode. Openings extending between the phosphorescent elements and through the anode. The baseplate, formed on a substrate, is mounted opposite and parallel to the faceplate. There is a reflective, conductive layer over the substrate. A plurality of electron-emitting tips are formed on the baseplate, extend through openings in the reflective, conductive layer, and are formed directly opposite to the phosphorescent elements, and are divided into smaller groups, or pixels. There is black matrix material over the anode around the periphery of each of the pixels. An anti-reflective layer is optionally formed over the interior surface of the glass plate, or only in the openings. Spacers with a reflective surface may be used, surrounding each pixel, to provide additional reflectivity.

11 Claims, 6 Drawing Sheets

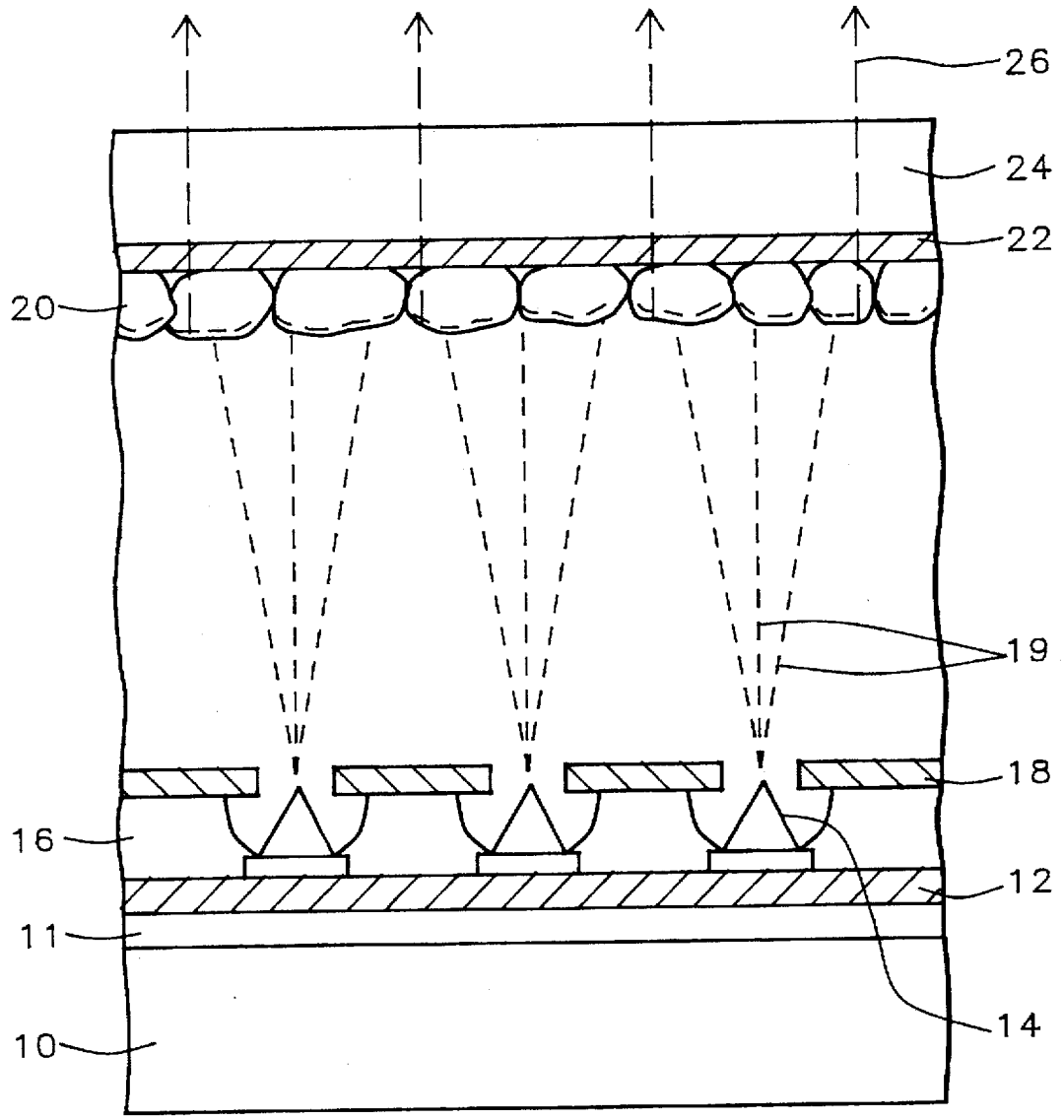
FIG. 1 – Prior Art

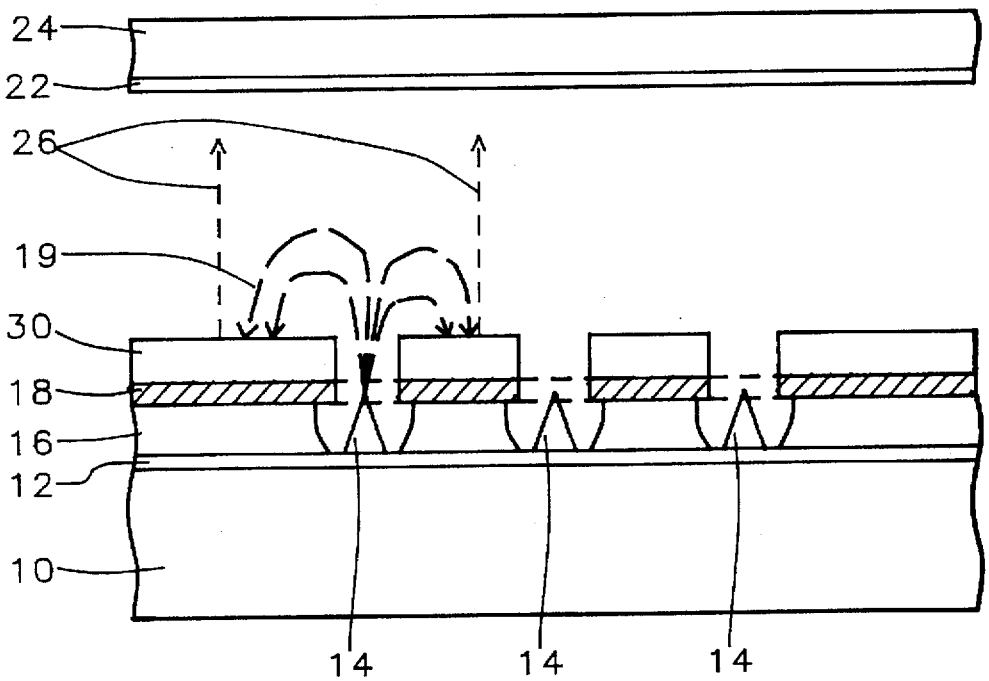
FIG. 2 – Prior Art
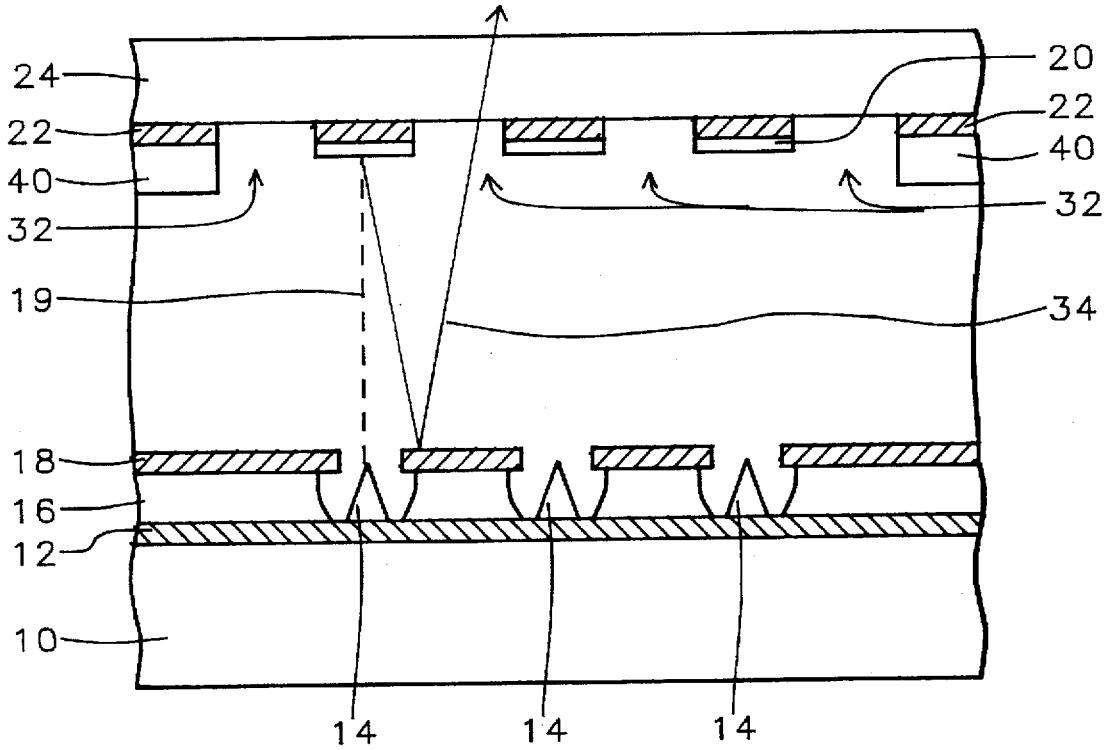
FIG. 3

PERFORATED SCREEN FOR BRIGHTNESS ENHANCEMENT

This application is a divisional of Ser. No. 08/387,082 now U.S. Pat. No. 5,595,519 filed Feb. 13, 1995.

BACKGROUND OF THE INVENTION (1) Field of the Invention

The invention relates to field emission flat panel displays, and more particularly to structures and methods of manufacturing field emission displays that provide brightness enhancements for improved end-user viewing.

(2) Description of the Related Art

In display technology, there is an increasing demand for flat, thin, lightweight displays to replace the traditional cathode ray tube (CRT) device. One of several technologies that provide this capability is field emission displays (FED). An array of very small, conical emitters is manufactured, typically on a semiconductor substrate, and can be addressed via a matrix of row and column electrodes. One set of these electrodes runs under and is electrically connected to the emitters and is usually referred to as the cathode. The other set of electrodes is formed above and perpendicular to the cathode lines and has an aperture surrounding the tip of each emitter, and is usually referred to as the gate. When a positive voltage differential is applied between the gate and cathode, a strong electric field is created at the emitter tips, and electron emission occurs. A third conductive surface, the anode, at a different voltage, attracts the emitted electrons. Cathodoluminescent material formed over the anode emits light when excited by the emitted electrons, thus providing the display element. The anode is typically mounted in close proximity to the cathode/gate/emitter structure.

FIG. 1 is a cross-sectional view of a typical field emission display of the related art. Row electrodes 12, or cathode, are formed on a substrate 10, and have emitter tips 14 mounted thereon. The emitters are separated by insulating layer 16. Column electrodes 18, the gate, with openings for the emitter tips, are formed over the insulating layer 16 and perpendicular to the row electrodes. When electrons 19 are emitted, they are attracted to conductive anode 22 and upon striking phosphor dot 20, light 26 is emitted, which can be viewed through the transparent faceplate 24. However, light 26 that is emitted in the direction of a viewer of the display, who would be looking through glass plate 24, must travel through the phosphor 20, the anode 22 and the glass 24. The luminous efficiency of the display is reduced primarily due to absorption by the phosphor.

Workers in the art are aware of this problem and have attempted to resolve it, with one approach disclosed in U.S. Pat. No. 5,216,324 (Curtin), in which the display image is viewed through the back plate, either by forming the conductive and insulating layers on the back plate of a transparent material, or making the conductive lines very thin, both of which increase the amount of light that can be transmitted to the viewer.

U.S. Pat. No. 4,908,539 to Meyer discloses a change in the location of the anode/phosphor 30, from the faceplate to the top of the column electrode 18, as shown in FIG. 2. This eliminates the light loss in the FIG. 1 structure that occurs as the emitted light passes through the phosphor. However, this method suffers from the problem of requiring a low-voltage phosphor, since otherwise the insulator may not be able to sustain the high voltage on the phosphor layer.

U.S. Pat. No. 4,857,799 (Spindt) discloses the use of phosphor strips and the fact that the close cathodephosphor spacing enables the gate structure to act as a reflective surface to increase the effective brightness. However, this arrangement suffers from degraded contrast at each pixel due to the lack of black material in the spaces between the phosphor strips.

SUMMARY OF THE INVENTION

It is therefore an object of this invention is to provide a field emission display with enhanced brightness while maintaining satisfactory contrast.

It is a further object of this invention to provide a method for manufacturing a field emission display with enhanced brightness while maintaining satisfactory contrast.

These objects are achieved by a field emission display having a baseplate and an opposing face plate, where a glass plate acts as a base for the faceplate. A patterned layer of transparent conductive material is formed over the glass plate, and acts as an anode for the display. There is a plurality of phosphorescent elements formed over the anode. Openings extending between the phosphorescent elements and through the anode. The baseplate, formed on a substrate, is mounted opposite and parallel to the faceplate. There is a reflective, conductive layer over the substrate. A plurality of electron-emitting tips are formed on the baseplate, extend through openings in the reflective, conductive layer, and are formed directly opposite to the phosphorescent elements, and are divided into smaller groups, or pixels. There is black matrix material over the anode around the periphery of each of the pixels. An anti-reflective layer is optionally formed over the interior surface of the glass plate, or only in the openings. Spacers with a reflective surface may be used, surrounding each pixel, to provide additional reflectivity.

These objects are further achieved by a method of manufacturing a faceplate with a glass base for a field emission display, in which the faceplate is mounted parallel and opposite to a baseplate that has a plurality of field emission microtips extending up from a substrate through openings formed in a sandwich structure of an insulating layer and a conductive layer. A transparent conductive layer is formed over the glass base. The field emission microtips are formed into groups, or pixels. Black matrix elements are formed over the transparent conductive layer, at periphery of the pixels. Phosphorescent elements are formed over the transparent conductive layer. Openings are formed between the phosphorescent elements and through the transparent conductive layer.

BRIEF DESCRIPTION OF THE DRAWINGS

FIGS. 1 and 2 are cross-sectional representations of prior art field emission display structures.

FIG. 3 is a cross-sectional representation of the invention in which there are openings in the phosphor layer of the field emission display to enhance the display brightness.

DESCRIPTION OF THE PREFERRED EMBODIMENTS

Figure 4:
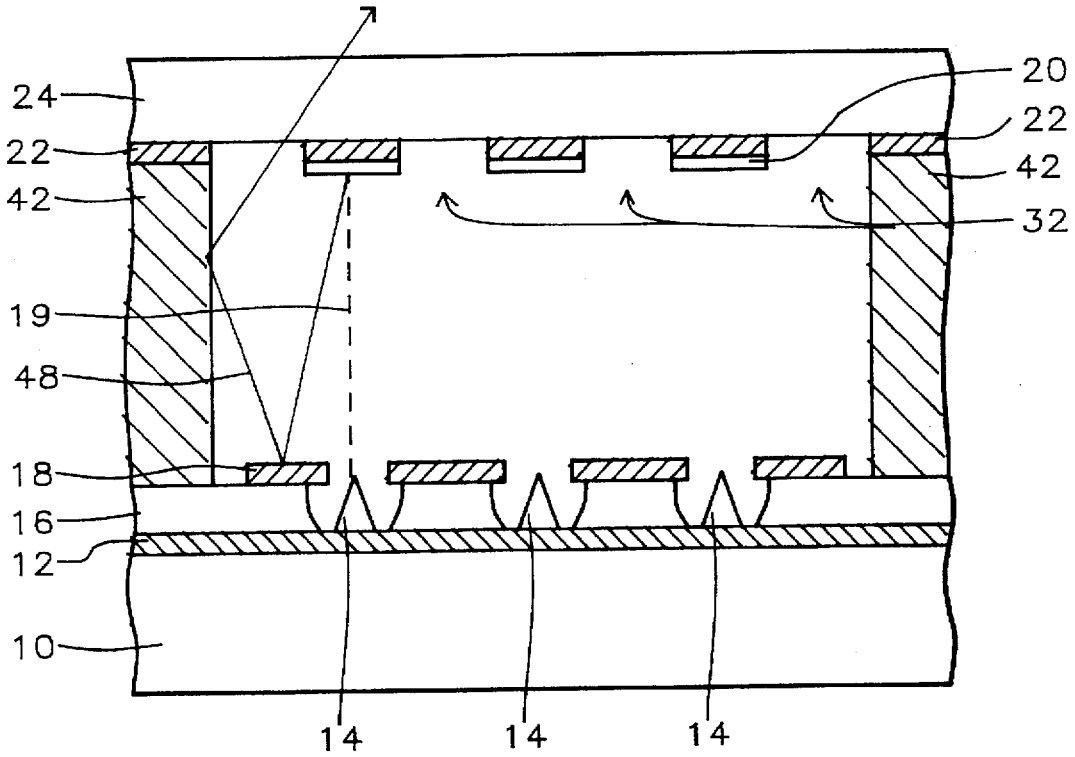
FIG. 4 is a cross-sectional representation of the invention in which spacers with a reflective surface are used at each color pixel to further enhance the brightness of the display.

Referring now to FIGS. 3 to 6, the structure and various embodiments of the invention are shown. Openings 32 are formed in the phosphor layer 20, so that when light is emitted from the phosphor 20, while some light will travel the same path shown in FIG. 1, other light will be emitted back toward the gate. Since the gate is typically formed of a reflective metal, such as Mo (molybdenum), Al (aluminum), Cr (chromium), Nb (niobium), or the like, the light will reflect off the gate and if following path 34 will pass through opening 32, the transparent anode 22 and transparent glass plate 24. Many such reflections take place and cumulatively increase the luminous efficiency of the display. For a color display, in which red, green and blue phosphors are used, the three phosphor elements 20 in FIG. 3 would be of the same color.

A typical field emission display is made up of many pixels, or individual display elements, which are formed at the intersections of the gate and cathode lines. From one to many thousands of emitters are formed at each pixel. Another feature of the invention is the use of a black matrix material 40 at the perimeter of each pixel, as shown in FIG. 3. This material, which is formed from C (carbon) as in CRT (cathode ray tube) technology, absorbs light that would otherwise reflect outside of the pixel and be erroneously emitted through an adjacent pixel location. In CRT manufacturing, the black matrix is typically coated first on the inside of the display surface, after which the primary color phosphors are deposited.

The spacing between the gate 18 and 22 is between about 5 and 500 micrometers. The two opposing plates of the display must be kept a constant distance apart, to insure a uniform display image. Also, a large pressure differential exists across the front plate due to the evacuation of the gate-anode space to about 1 E-6 torr. To maintain the flat surface of the front plate and keep a uniform distance, spacers 42 are formed between the two opposing plates of the display, as shown in FIG. 4. Another feature of the invention is to form these spacers with a reflective surface and surrounding each pixel, where the anode-gate spacing is at the higher end of the range given above, to confine reflected light within the pixel. Where the spacing is at the lower end of the range, ball spacers may be used since any light scattered between adjacent pixels are absorbed satisfactorily by the black matrix. As shown in FIG. 4, when reflected light follows path 48 toward the periphery of a pixel, the light is reflected back out through the front face for further brightness enhancement, rather than being absorbed by black matrix material as would be the case in the FIG. 3 embodiment.

Figure 5:
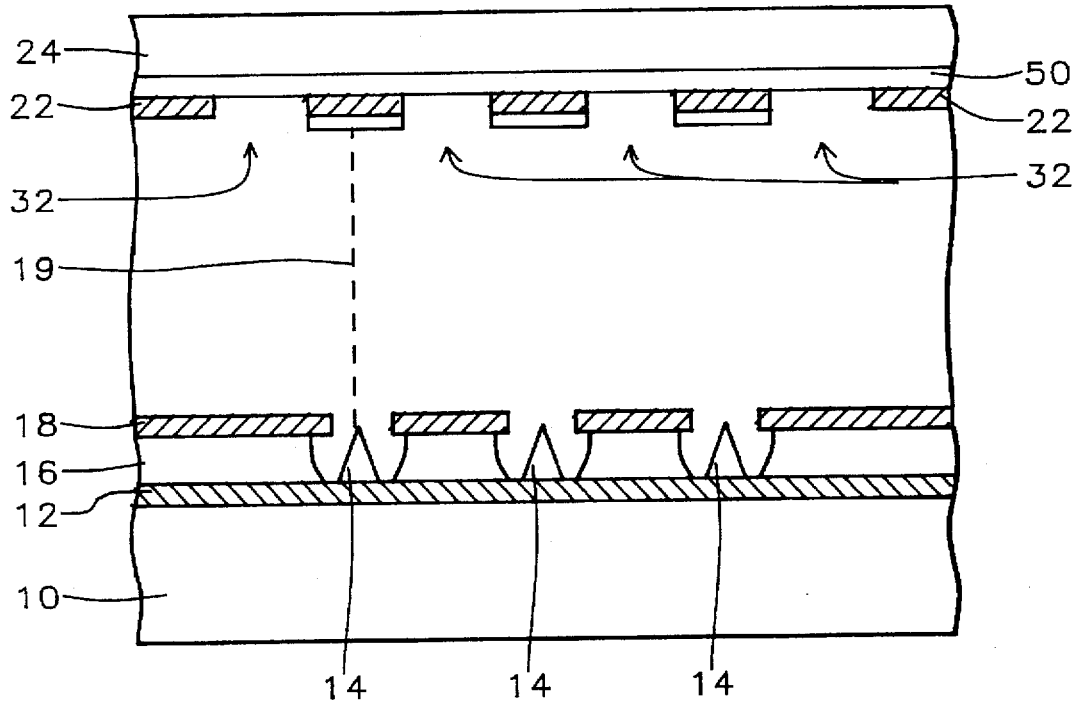
FIG. 5 is a cross-sectional representation of the invention in which an anti-reflective layer is added to the inner surface of the front glass plate, at the phosphor openings, of a field emission display to enhance brightness.

Referring now to FIG. 5, a further brightness enhancement of the invention is the addition of an anti-reflective coating 50 on the display backplate. This coating may be applied across the entire inner surface of the glass plate 24, as shown in FIG. 5, or only in phosphor openings 32. This decreases reflection off the inner glass surface, and materials that may be used for this purpose include the commonly used antireflective coatings such as $MgF_{12}$ (magnesium fluoride) or $CaF_{12}$ (calcium fluoride) or the like. The anti-reflective layer 50 is formed to a thickness of between about 3000 and 10,000 Angstroms. AR (antireflective) materials are often applied to the outside of display surfaces to reduce glare, while as part of the invention the AR layer is also formed on the inner side of the front glass plate 24. For those methods of the prior art in which the light is viewed through the backplate, it would be difficult to apply the AR coating.

Figure 6:
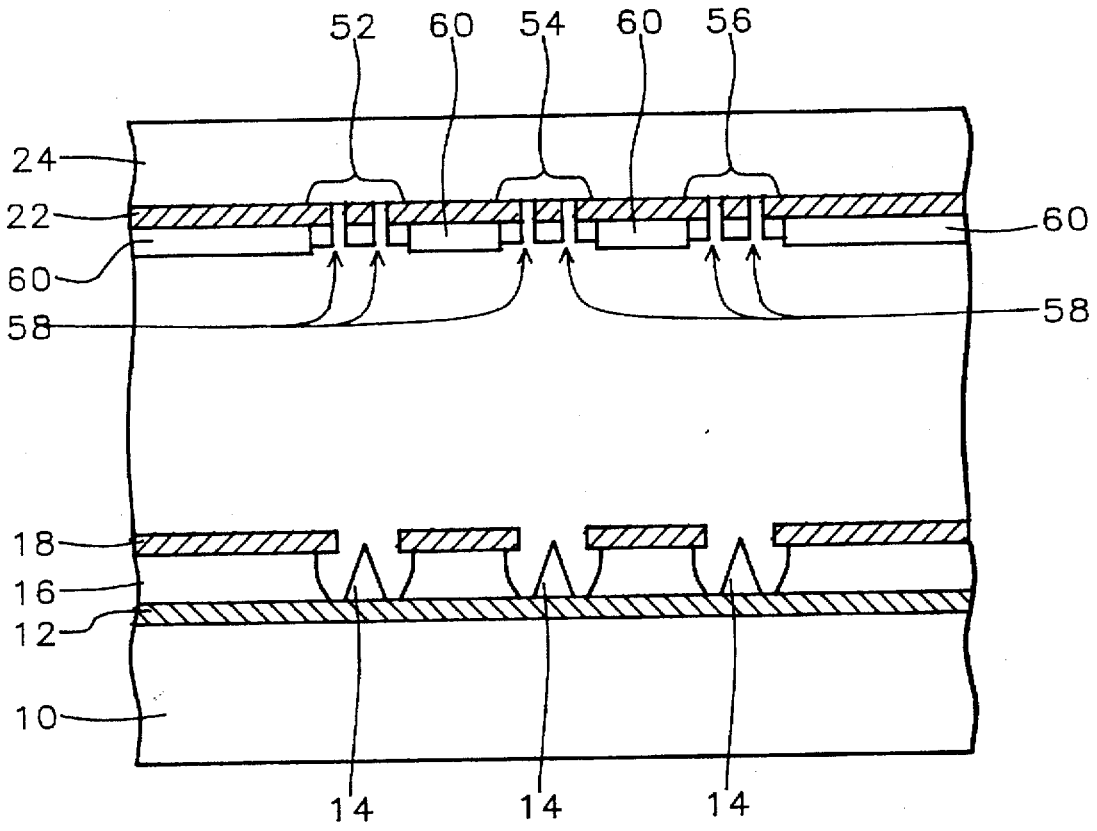
FIG. 6 is a cross-sectional representation of an alternative structure of the invention.
Figure 7:
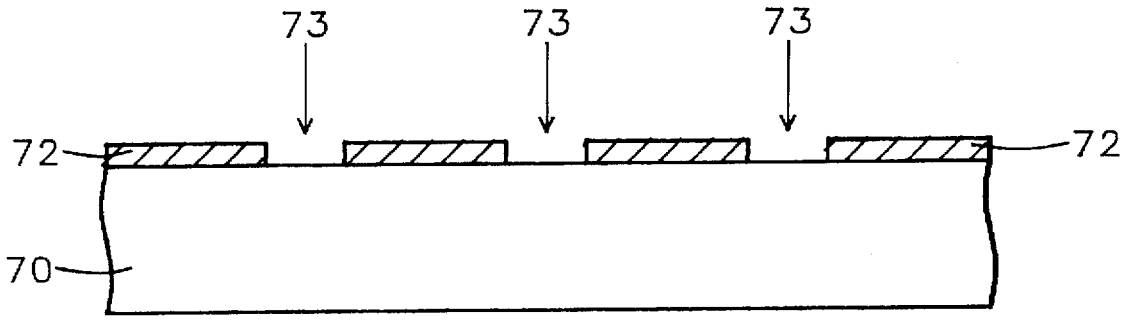
FIGS. 7, 8, 9, 10 and 11 are a cross-sectional representation of the method of the invention for forming a field emission display faceplate.

With reference to FIG. 6, another embodiment of the invention is shown in which the display brightness is enhanced by forming holes in what are normally solid phosphor sections. In a color display, phosphors 52, 54 and 56 would correspond to red, green and blue phosphors, for example, and openings 58 formed in each of these phosphors to allow for passage of light. Black matrix 60 may be formed at the periphery of each pixel, or also between each of the phosphors 52, 54, and 56, as shown in FIG. 6, to provide improved contrast.

The method for forming the various features of the present invention are now described, with reference to FIGS. 7 to 11. A transparent glass faceplate 70 is provided, having a thickness of between about 0.4 and 1.1 millimeters. A transparent, conductive film such as indium tin oxide (ITO) is next deposited and patterned with openings 73 to form a layer 72, having a thickness of between about 1000 and 5000 Angstroms, and is used as the anode for the field emission display.

Figure 8:
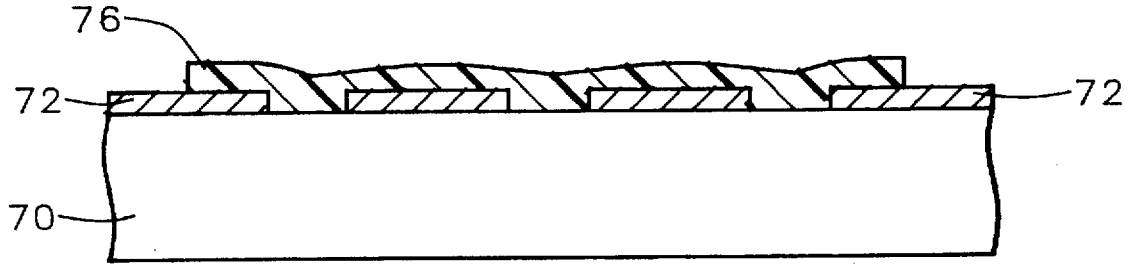
Figure 9:
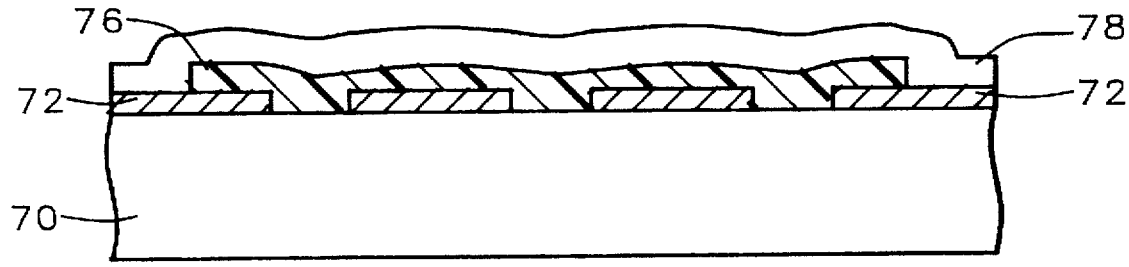
Figure 10:
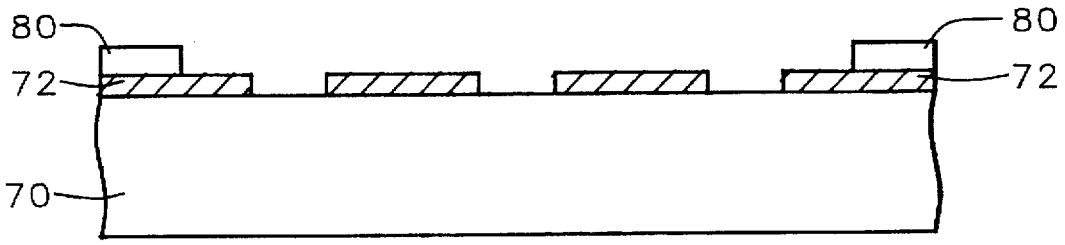

Referring now to FIGS. 8 to 10, the black matrix 80 is formed by first patterning a negative photoresist layer 76, then spraying a carbon layer 78 having a thickness of between about 5 and 20 micrometers. Sulfamic acid spray is then applied and development takes place, removing the photoresist and excess carbon, leaving black matrix 80 patterned as in FIG. 10, at the outer edges of each pixel.

Figure 11:
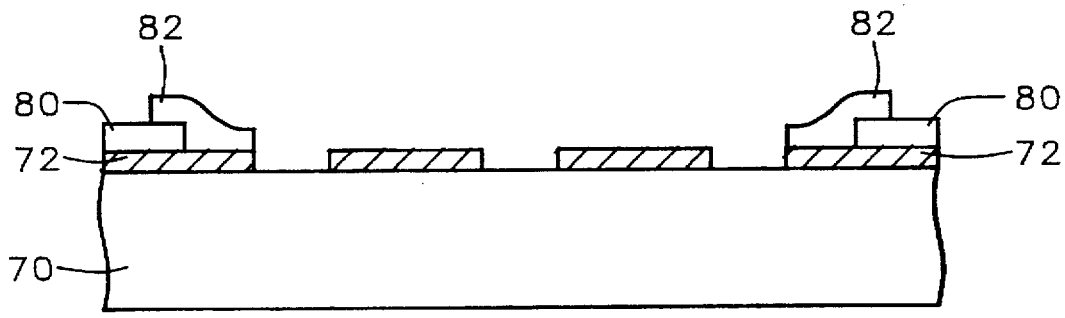

Phosphor 82 is then formed on the anode 72, in the pattern shown in FIG. 11, by, deposition, exposure and development of light sensitive polyvinyl alcohol (PVA) resist, to product the desired pixel color. Other methods, such as screen printing or electrophoresis may also be used to form the phosphors. They are formed to a thickness of between about 2 and 30 micrometers, and a preferred range of between about 3 and 8 micrometers, so that absorption of light is minimized and screen brightness maximized.

The faceplate structure is now mounted to a baseplate on which has already been formed field emission microtips, to result in the FIG. 3 structure. The formation of the baseplate and emitters will not be described in detail as it is known in the art and not significant to the invention. Many thousands, or even millions, of microtips are formed simultaneously on a single baseplate in the formation of a field emission display. As noted earlier, the faceplate and backplate structures are formed such that there are no emitters opposite the phosphor openings.

Also as previously noted, spacers are needed to mount the faceplate and backplate, which must be kept a constant distance apart, where the distance is between about 5 and 500 micrometers, to insure a uniform display image. Spacer formation is well known in the art, and so will not be described in detail. For purposes of the invention, reflective rib spacers are used where the anode-gate spacing is at the higher end of the range given above, to confine reflected light within the pixel. One method of forming such spacers is described for a plasma display panel application in "Fabrication of Fine Barrier Ribs for Color Plasma Display Panels by Sandblasting", Y. Terao, et al., SID '92 Digest, pp. 724–726. After deposition of the spacer material and mask formation, a fine powder such as Alumina is blown against the exposed spacer material and etching accomplished due to the physical impact of the powder. The spacers of the invention are required to be reflective, so the sandblasting method above could be used but with a Ni (nickel) paste used as the spacer material.

Where the anode-gate spacing is at the lower end of the range, ball spacers may be used since any light scattered between adjacent pixels are absorbed satisfactorily by the black matrix.

While the invention has been particularly shown and described with reference to the preferred embodiments thereof, it will be understood by those skilled in the art that various changes in form and details may be made without departing from the spirit and scope of the invention.

What is claimed is:

1. A field emission display having a baseplate and an opposing face plate, with brightness enhancements, comprising:

a glass plate, acting as a base for said faceplate;

a patterned layer of transparent conductive material, which acts as an anode for said display;

a plurality of phosphorescent elements formed over said anode;

openings extending between said phosphorescent elements and through said anode;

said baseplate, formed on a substrate, which is mounted opposite and parallel to said faceplate;

a reflective, conductive layer over said substrate;

a plurality of electron-emitting tips formed on said baseplate, extending through openings in said reflective, conductive layer, and formed directly opposite to said phosphorescent elements, and which are divided into smaller groups, or pixels; and black matrix material formed over said anode around the periphery of each of said pixels.

2. The field emission display of claim 1 further comprising an anti-reflective layer over the interior surface of said glass plate.

3. The field emission display of claim 2 wherein said anti-reflective layer is formed only in said openings.

4. The field emission display of claim 3 wherein said anti-reflective layer is selected from the group consisting of $MgF_{12}$ (magnesium fluoride) and $CaF_{12}$ (calcium fluoride).

5. The field emission display of claim 4 wherein said anti-reflective layer has a thickness of between about 3000 and 10,000 Angstroms.

6. The field emission display of claim 1 wherein said black matrix material is sprayed carbon having a thickness of between about 5 and 20 micrometers.

7. The field emission display of claim 1 further comprising spacers with a reflective surface mounted between said faceplate and said baseplate, surrounding each of said pixels, whereby said spacers provide additional reflectivity.

8. A field emission display having a baseplate and an opposing face plate, with brightness enhancements, comprising:

a glass plate, acting as a base for said faceplate;

a patterned layer of transparent conductive material, which acts as an anode for said display;

a plurality of phosphorescent elements formed over said anode;

openings extending between said phosphorescent elements and through said anode;

anti-reflective material in said openings;

said baseplate, formed on a substrate, which is mounted opposite and parallel to said faceplate;

a reflective, conductive layer over said substrate;

a plurality of electron-emitting tips formed on said baseplate, extending through openings in said reflective, conductive layer, and formed directly opposite to said phosphorescent elements, and which are divided into smaller groups, or pixels; and black matrix material formed over said anode around the periphery of each of said pixels.

9. The field emission display of claim 8 further comprising anti-reflective material under said anode.

10. The field emission display of claim 8 wherein said anti-reflective layer is selected from the group consisting of $MgF_{12}$ (magnesium fluoride) and $CaF_{12}$ (calcium fluoride).

11. The field emission display of claim 8 wherein said anti-reflective layer has a thickness of between about 3000 and 10,000 Angstroms.

* * * * *